US009527638B2

(12) United States Patent
Yoo et al.

(10) Patent No.: US 9,527,638 B2
(45) Date of Patent: Dec. 27, 2016

(54) STORAGE CONTAINER AND REFRIGERATOR HAVING THE SAME

(71) Applicant: Samsung Electronics Co., Ltd., Suwon-si (KR)

(72) Inventors: Chae Hyun Yoo, Suwon-si (KR); Wan Ku Kang, Uiwang-si (KR); Jong Ho Lee, Yongin-si (KR); Dae Yun Kim, Incheon (KR); Jea Won Lee, Hwaseong-si (KR); Jee Hoon Lee, Goyang-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/467,329

(22) Filed: Aug. 25, 2014

(65) Prior Publication Data

US 2015/0059398 A1 Mar. 5, 2015

(30) Foreign Application Priority Data

Aug. 30, 2013 (KR) ..... 10-2013-0104336

(51) Int. Cl.
*B65D 51/16* (2006.01)
*F25D 25/00* (2006.01)
(Continued)

(52) U.S. Cl.
CPC ..... *B65D 51/1616* (2013.01); *A47G 19/26* (2013.01); *B65D 25/2802* (2013.01); *B65D 81/18* (2013.01);
(Continued)

(58) Field of Classification Search
CPC . B65D 51/1616; B65D 51/1605; B65D 51/16; B65D 25/00; B65D 51/30; B65D 51/28; B65D 81/18; B65D 25/2802; F25D 17/04; F25D 17/00; F25D 11/00; F25D 17/042; F25D 25/005; B65F 1/1447; B65F 1/1426
(Continued)

(56) References Cited

U.S. PATENT DOCUMENTS 1,259,047 A 3/1918 Richardson
3,041,852 A * 7/1962 Palmer ..... B65F 1/163 220/263
(Continued)

FOREIGN PATENT DOCUMENTS

DE EP 0706018 A2 * 4/1996 ..... B65F 1/14
DE 29901643 8/2000
(Continued)

OTHER PUBLICATIONS

Translation of DE 29901643 (Bonsmann), Aug. 3, 2000, pp. 10 and 14.*
(Continued)

*Primary Examiner* — Robert J Hicks
(74) *Attorney, Agent, or Firm* — Staas & Halsey LLP

(57) ABSTRACT

A storage container includes an inflow hole and an outflow hole through which cold air flows, and deodorizing filters for removing odorous materials are mounted in the inflow hole and the outflow hole. Therefore, when foods containing odor-causing materials are put in the storage container to be stored in a storage compartment, the odor-causing materials are prevented from spreading inside the storage compartment, thereby fundamentally removing odors from the storage compartment. In addition, the cold air of the storage compartment continuously flows in and out of the storage container through the inflow hole and the outflow hole, and therefore foods stored in the storage container may be kept fresh.

15 Claims, 11 Drawing Sheets

(51) Int. Cl.

| | |
|---|---|
| ***B65D 25/28*** | (2006.01) |
| ***B65D 81/18*** | (2006.01) |
| ***F25D 17/04*** | (2006.01) |
| ***A47G 19/26*** | (2006.01) |
| ***F25D 11/00*** | (2006.01) |

(52) U.S. Cl.
CPC ..... *F25D 11/00* (2013.01); *F25D 17/04* (2013.01); *F25D 17/042* (2013.01); *F25D 25/005* (2013.01); *F25D 2317/0415* (2013.01); *F25D 2317/0654* (2013.01); *F25D 2317/0664* (2013.01)

(58) Field of Classification Search
USPC ..... 220/371, 367.1, 745, 592.02, 676, 87.1; 62/407
See application file for complete search history.

(56) References Cited

U.S. PATENT DOCUMENTS 3,161,030 A * 12/1964 Lee ..... B65F 1/14 62/378
3,982,407 A * 9/1976 Guenette ..... B65F 1/1426 62/441
5,031,796 A * 7/1991 Schafer ..... B65F 1/14 220/371
5,174,462 A * 12/1992 Hames ..... B65F 7/00 220/522
5,465,901 A * 11/1995 Paine, Jr. ..... B65D 1/38 220/4.23
6,715,628 B1 4/2004 Nichols et al.

FOREIGN PATENT DOCUMENTS

| | | |
|---|---|---|
| JP | 11-325705 | 11/1999 |
| JP | 2001-224508 | 8/2001 |
| JP | 2002-090053 | 3/2002 |
| KR | 20-2002-0036688 | 12/2002 |
| KR | 10-2004-0102132 | 12/2004 |
| WO | WO 97/30910 | 8/1997 |

OTHER PUBLICATIONS

Translation of EP0706018 (Hering et al.), Apr. 10, 1996, p. 2.*
Extended European Search Report dated Apr. 24, 2015 in European Patent Application No. 14182805.3.

* cited by examiner

STORAGE CONTAINER AND REFRIGERATOR HAVING THE SAME

CROSS-REFERENCE TO RELATED APPLICATIONS

This application claims the priority benefit of Korean Patent Application No. 10-2013-0104336, filed on Aug. 30, 2013 in the Korean Intellectual Property Office, the disclosure of which is incorporated herein by reference.

BACKGROUND

1. Field

The following description relates to a container in which foods may be kept fresh by enabling cold air of a storage compartment to be smoothly ventilated inside the container while preventing odorous materials of foods from spreading inside the storage compartment, and a refrigerator having the same.

2. Description of the Related Art

In general, a refrigerator is a device which includes a storage compartment and a cold air supplying device for supplying cold air to the storage compartment to keep foods fresh. Various foods are stored in the storage compartment, and particularly, foods with many odor-causing materials such as kimchi, fish, and the like may also be stored. A large number of sulfur-based odor-causing materials such as methyl mercaptan, di-2-propenyl disulfide, diallyl disulfide, and the like are contained in kimchi, and a large number of nitrogen-based odor-causing materials such as trimethylamine, piperidine, acetaldehyde, ammonia, dimethylamine, and the like are contained in fish, from which odors are generated.

In the storage compartment of the refrigerator, a deodorizer for removing these odor-causing materials of foods may be provided. The deodorizer includes a deodorizing filter that removes the odor-causing materials and a deodorizing fan that sucks air inside the storage compartment and forces the sucked air to flow using the deodorizing filter.

However, because the deodorizer removes the odor-causing materials which have already spread inside the storage compartment, it is difficult to completely remove the odors from the inside of the storage compartment. In addition, because the deodorizing fan should be operated, the deodorizing filter should be disposed in the vicinity of a cold air suction port or a discharging port when additional energy is consumed or the deodorizing fan is omitted, and therefore a flow of the cold air is interrupted.

Meanwhile, a sealed container for sealing and storing foods to prevent odor-causing materials from spreading inside the storage compartment may be used. However, such a sealed container can prevent the odor-causing materials from spreading, but cannot remove the odor-causing materials themselves, and therefore deformation such that the sealed container is billowed due to an increase in an internal pressure by the odor-causing materials over long-term use, or the like may occur. In addition, because the inside and the outside of the sealed container cannot be ventilated, supply of cold air of the storage compartment to the sealed container is blocked, whereby foods cannot be kept fresh.

SUMMARY

Therefore, it is an aspect of the present disclosure to provide a container that may fundamentally remove odors from a storage compartment by preventing odor-causing materials from spreading inside the storage compartment while keeping foods stored inside the storage compartment fresh, and a refrigerator having the same.

Additional aspects of the disclosure will be set forth in part in the description which follows and, in part, will be obvious from the description, or may be learned by practice of the disclosure.

In accordance with an aspect of the present disclosure, a storage container includes: a lower case whose upper surface is opened; an upper case that is detachably coupled to an upper portion of the lower case to cover the opened upper surface of the lower case, and coupled to the upper portion of the lower case to form an inner storage space together with the lower case; at least one inflow hole that is provided in the lower case or the upper case to enable outside air to flow into the storage space; at least one outflow hole that is provided in the lower case or the upper case to enable air of the storage space to flow to the outside; and a plurality of deodorizing filters that are respectively mounted in the at least one inflow hole and the at least one outflow hole.

Here, a gap between the lower case and the upper case may be sealed so that the outside air flows into and out of the storage space only through the at least one inflow hole and the at least one outflow hole.

Also, the deodorizing filters may be detachably mounted in the at least one inflow hole and the at least one outflow hole.

Also, the at least one inflow hole and the at least one outflow hole may be respectively formed at a rear side of the case and a front side thereof, or respectively formed at both sides of the case so that the at least one inflow hole and the at least one outflow hole face each other.

Also, the at least one inflow hole and the at least one outflow hole may be formed on both side walls of the lower case in such a manner that an upper end of each of the at least one inflow hole and the at least one outflow hole is opened, so that the deodorizing filters are mounted to travel downward from above through the opened upper end.

Also, the deodorizing filters may be fitted into both of the side walls of the lower case.

Also, the deodorizing filters may include coupling grooves into which the lower case is fitted.

Also, an elastic hook may be provided in the deodorizing filters, a latching hole in which the elastic hook is inserted may be provided on both of the side walls of the lower case, and the elastic hook may be inserted in and fixed to the latching hole, so that the deodorizing filters are fixed while mounted.

Also, a handle unit may be respectively formed in a front wall of the lower case and a rear wall thereof.

Also, the deodorizing filters may include activated carbon having a plurality of pores that adsorbs odorous materials, and a catalyst that is impregnated in the activated carbon to help chemical adsorption of the odorous materials.

Also, the catalyst may include a catalyst that is specialized in adsorption of acidic and basic odors.

In accordance with an aspect of the present disclosure, a storage container includes: a lower case whose upper surface is opened; an upper case that is detachably coupled to an upper portion of the lower case to cover the opened upper surface of the lower case, and coupled to the upper portion of the lower case to form an inner storage space together with the lower case; at least one ventilation hole that is provided in the lower case or the upper case to enable outside air to flow into the storage space; and at least one deodorizing filter that is mounted in the at least one ventilation hole.

In accordance with an aspect of the present disclosure, a refrigerator includes: a main body; a storage compartment that is formed inside the main body; a door that opens and closes the storage compartment; and a storage container that is received in the storage compartment, wherein the storage container includes a lower case and an upper case which form an inner storage space and are detachably coupled to each other; at least one ventilation hole that is formed in the lower case or the upper case to enable cold air of the storage compartment to flow into and out of the storage space; and at least one deodorizing filter that is mounted in the at least one ventilation hole to prevent odors of foods received in the storage space of the storage container from spreading to the storage compartment.

Here, the at least one deodorizing filter may be detachably mounted in the at least one ventilation hole.

Also, the at least one ventilation hole may include at least one inflow hole through which cold air of the storage compartment flows into the storage space of the storage container, and at least one outflow hole through which air of the storage space of the storage container flows out into the storage compartment.

Also, the lower case may include a front wall, a rear wall, both side walls, and a bottom portion, the at least one ventilation hole may be formed on each of the side walls, and a handle may be formed on each of the front wall and the rear wall.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
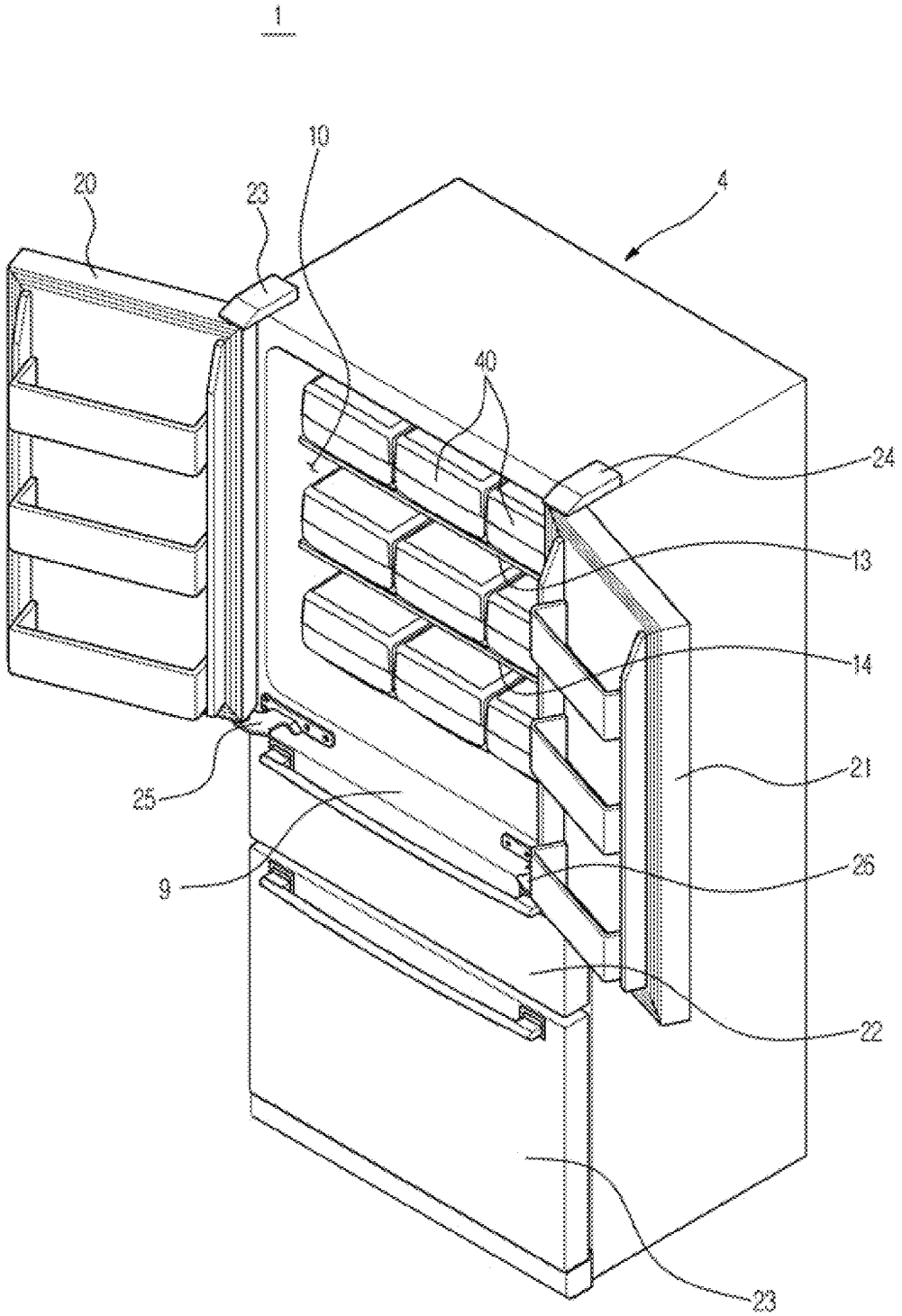
FIG. 1 shows an appearance of a refrigerator in accordance with an embodiment of the present disclosure.

Reference will now be made in detail to the embodiments of the present disclosure, examples of which are illustrated in the accompanying drawings, wherein like reference numerals refer to like elements throughout.

Hereinafter, embodiments of the present disclosure will be described in detail.

FIG. 1 shows an appearance of a refrigerator in accordance with an embodiment of the present disclosure.

Referring to FIG. 1, a refrigerator 1 includes a main body 4, a storage compartment provided inside the main body 4 to store foods, and a cold air supplying device (not shown) that supplies cold air to the storage compartment.

The cold air supplying device may include a compressor, a condenser, an expansion valve, an evaporator, a blowing fan, a cold air duct, and the like.

The storage compartment may be vertically divided into an upper chamber 10, an intermediate chamber (not shown), and a lower chamber (not shown) in the stated order. Each chamber may refrigerate and store foods or freeze and store foods, as necessary.

The upper chamber 10 and the middle chamber may be divided by an intermediate partition wall 9. A front surface of each of the upper chamber 10, the intermediate chamber, and the lower chamber may be opened so that foods may be put in and taken out of the storage compartment chambers.

The opened front surfaces of the intermediate chamber and the lower chamber may be opened and closed by drawers 22 and 23 slidably coupled to the main body 4, respectively.

The opened front surface of the upper chamber 10 may be opened and closed by a first door 20 and a second door 21 which are rotatably coupled to the main body 4. The first door 20 and the second door 21 may be rotatably coupled to the main body 4 through upper hinges 23 and 24 and lower hinges 25 and 26, respectively. In the upper chamber 10, at least one shelf 13 on which foods can be placed may be disposed. The upper chamber may also contain a second shelf 14.

As shown in FIG. 1, storage containers 40 for storing foods as well as the foods may be disposed in the shelves 13 and 14. The number of storage containers 40 disposed in the shelves 13 and 14 is not limited. For example, a plurality of storage containers 40 may be disposed adjacent to each other as shown in FIG. 1, or a smaller number of storage containers than the number of storage containers 40 shown or only one storage container 40 may be disposed.

In the storage container 40, foods with many odor-causing materials may be stored in the storage container 40. For example, kimchi containing a large number of sulfur-based odor-causing materials such as methyl mercaptan, di-2-propenyl disulfide, diallyl disulfide, and the like, or fish or cheese containing a large number of nitrogen-based odor-causing materials such as trimethylamine, piperidine, acetaldehyde, ammonia, dimethylamine, and the like may be stored in the storage container 40.

The storage container 40 may prevent odor-causing materials contained in the stored foods from spreading to the outside of the storage container 40. Thus, when the foods containing the above-described odor-causing materials are put in the storage container 40 to be stored in the storage compartment, it is possible to fundamentally prevent odors from being generated in the storage compartment. In addition, the storage container 40 may keep the stored foods fresh by enabling cold air to be smoothly supplied to the stored foods.

A specific configuration and operation of such a storage container 40 will be described with reference to FIGS. 2 to 6.

Figure 2:
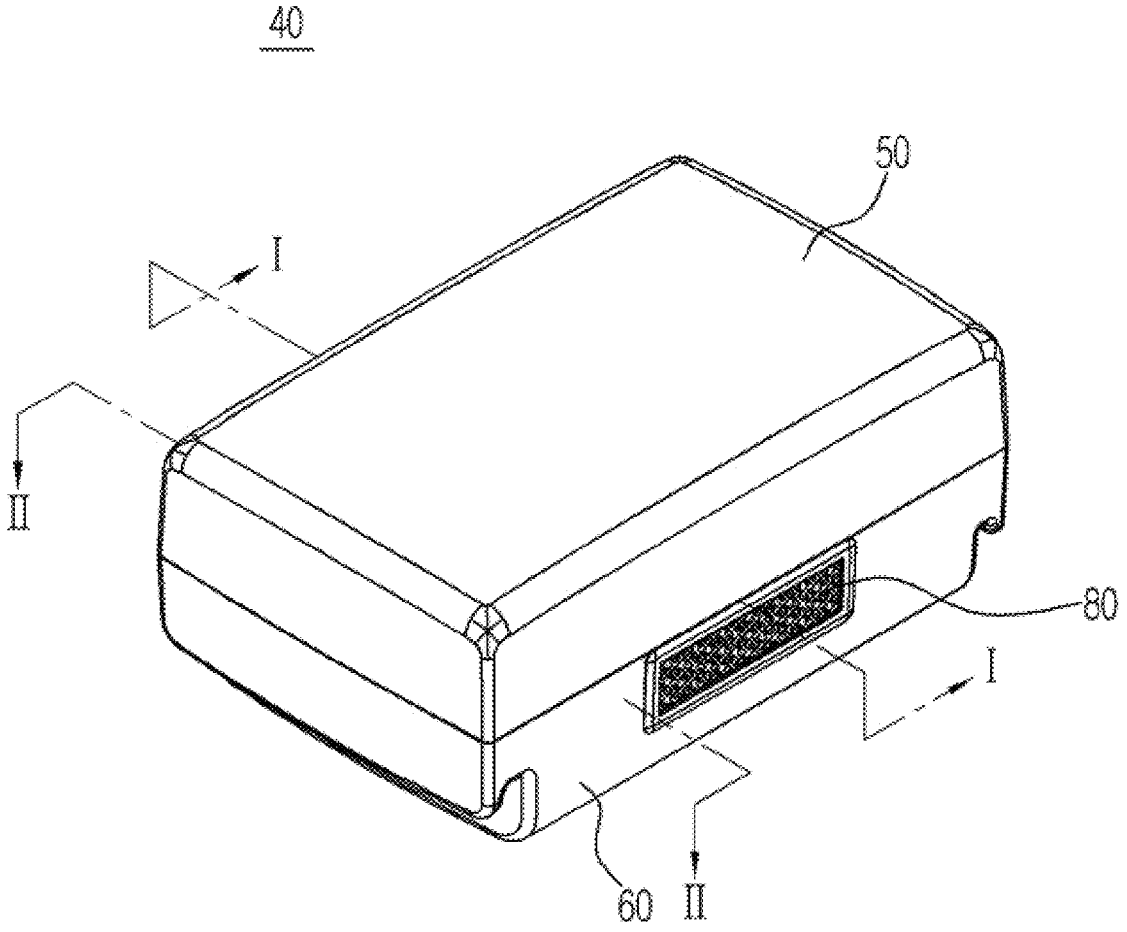
FIG. 2 shows an appearance of a storage container of the refrigerator of FIG. 1.
Figure 3:
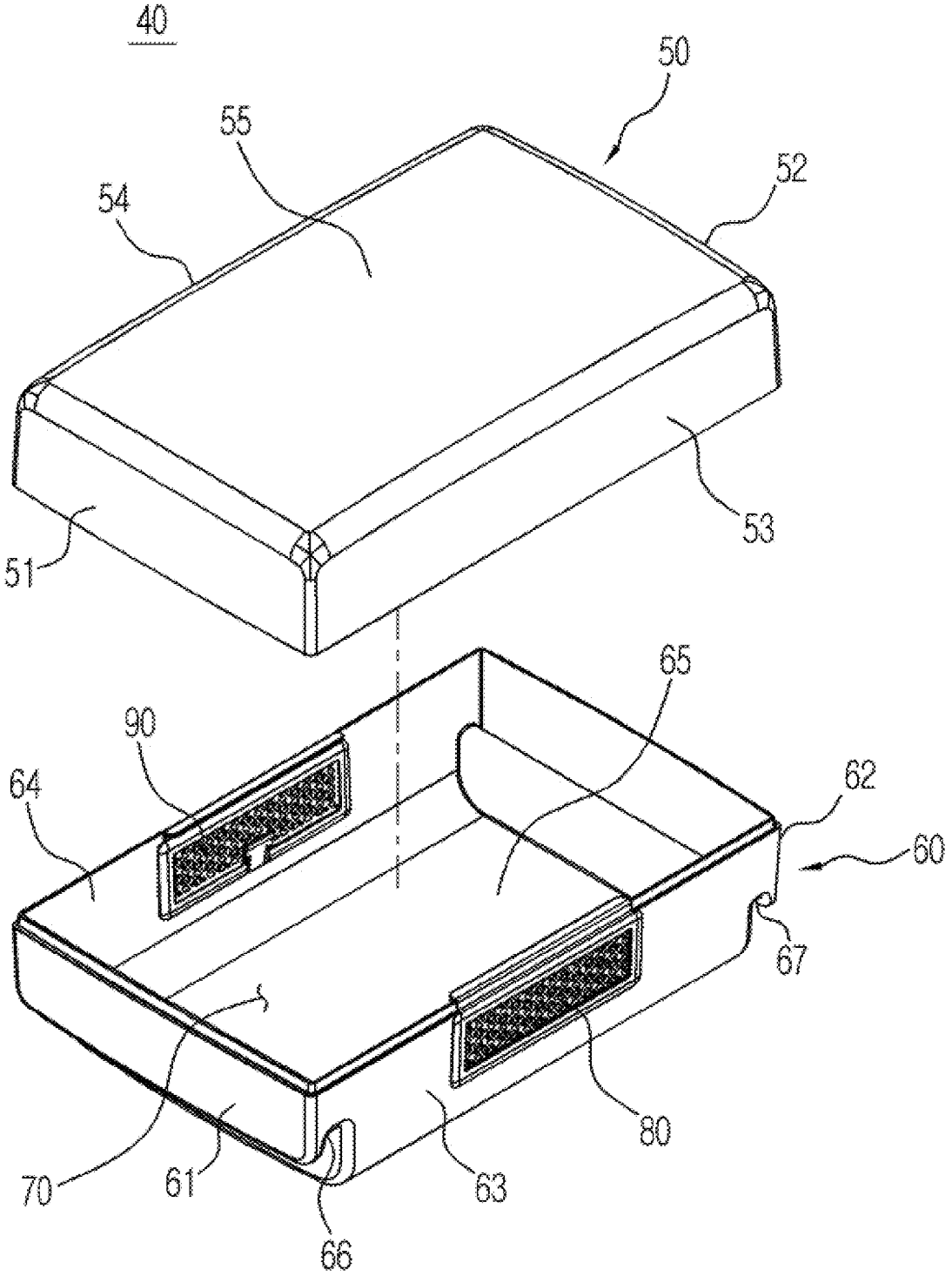
FIG. 3 is a perspective view showing a state in which an upper case and a lower case of the storage container of the refrigerator of FIG. 1 are separated from each other.
Figure 4:
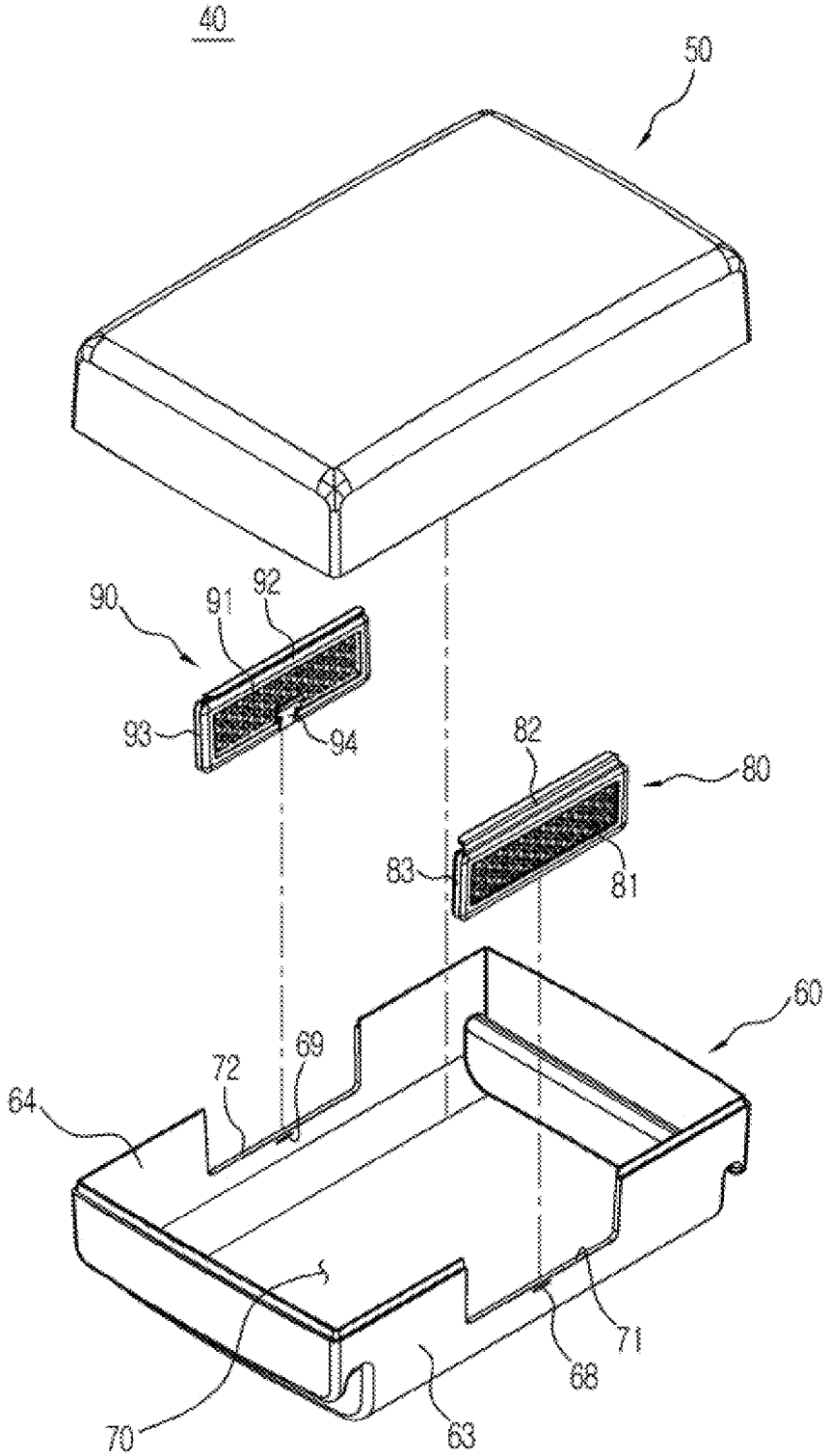
FIG. 4 is a perspective view showing a state in which a deodorizing filter of the storage container of the refrigerator of FIG. 1 is separated from the storage container.
Figure 5:
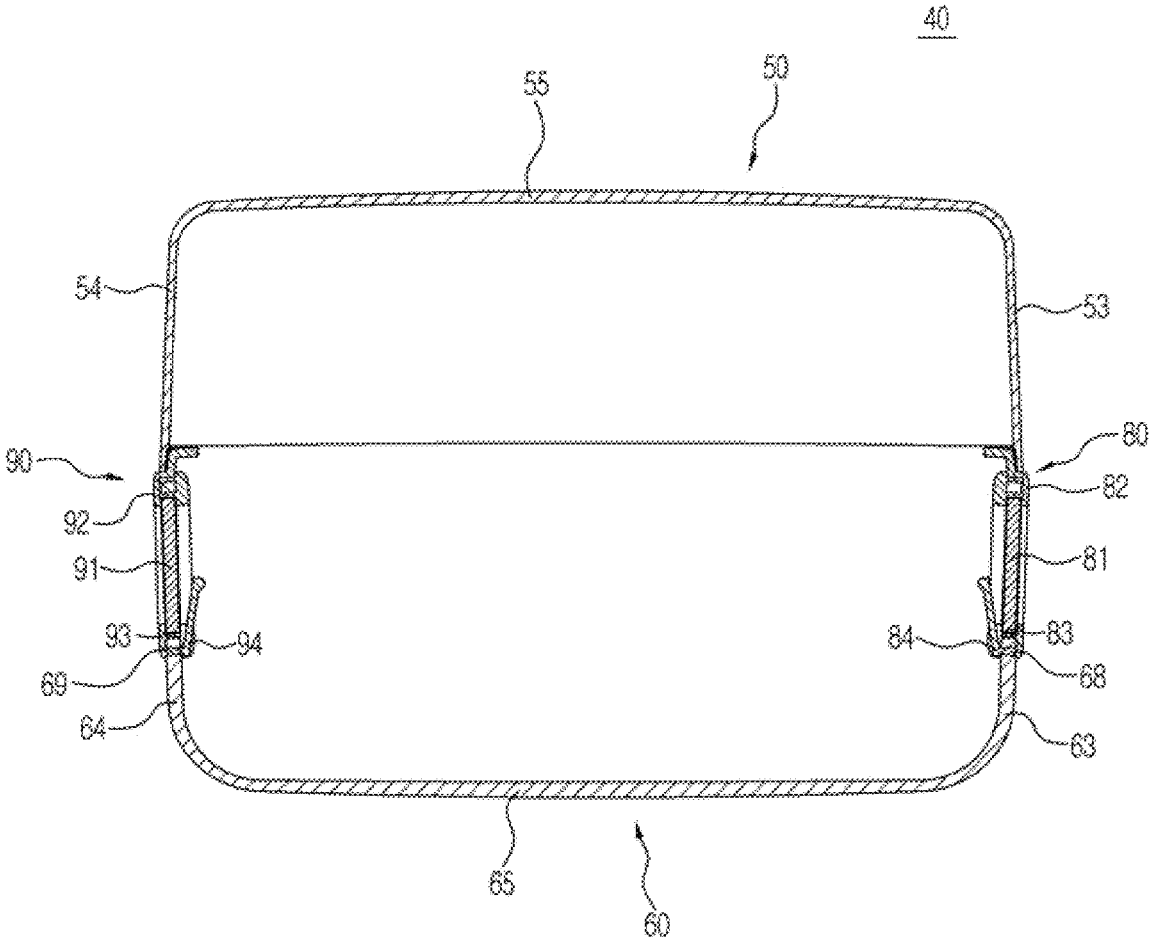
FIG. 5 is a cross-sectional view taken along line I-I in FIG. 2.
Figure 6:
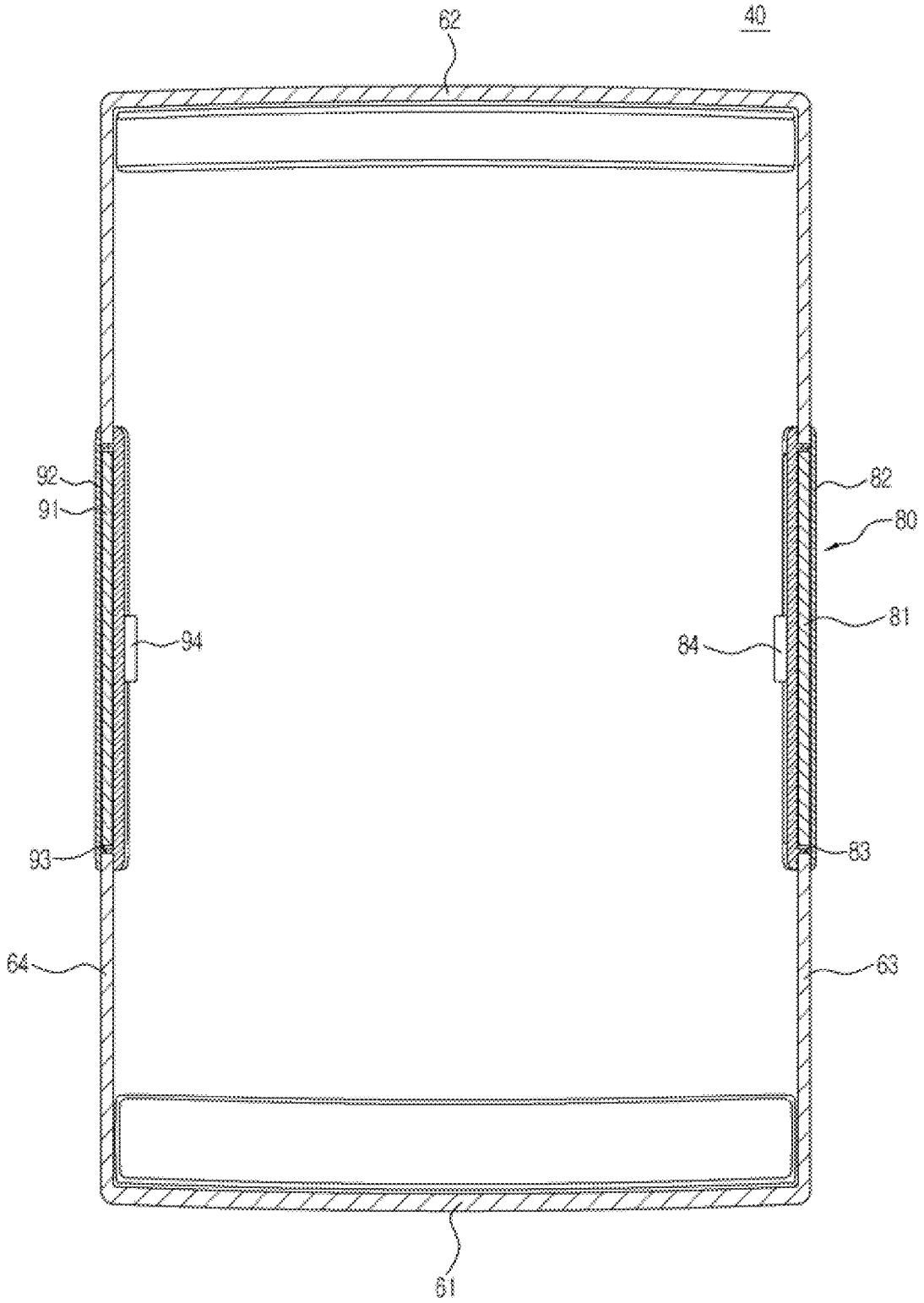
FIG. 6 is a cross-sectional view taken along line II-II in FIG. 2.

FIG. 2 shows an appearance of a storage container of the refrigerator of FIG. 1, FIG. 3 is a perspective view showing a state in which an upper case and a lower case of the storage container of the refrigerator of FIG. 1 are separated from each other, FIG. 4 is a perspective view showing a state in which a deodorizing filter of the storage container of the refrigerator of FIG. 1 is separated from the storage container, FIG. 5 is a cross-sectional view taken along line I-I in FIG. 2, and FIG. 6 is a cross-sectional view taken along line II-II in FIG. 2.

Referring to FIGS. 2 to 6, the storage container 40 includes a lower case 60 and an upper case 50 coupled to an upper portion of the lower case 60.

The lower case 60 may be provided in approximately a box shape, and an upper surface of the lower case 60 is provided to be opened. The lower case 60 includes a front wall 61, a rear wall 62, a left wall 63, a right wall 64, and a bottom portion 65. In the front wall 61 and the rear wall 62, handle units 66 and 67 for pushing and pulling the storage container 40 in and out while holding the storage container 40 may be formed to be recessed.

The upper case 50 is a lid that covers the upper surface of the lower case 60, and is coupled to the upper portion of the lower case 60. The upper case 50 is detachably coupled to the upper portion of the lower case 60. By putting the upper case 50 on the lower case 60, the upper case 50 and the lower case 60 may be coupled to each other, and by simply lifting the upper case 50, the upper case 50 may be separated from the lower case 60.

In order to prevent the odor-causing materials from leaking through a gap between the upper case 50 and the lower case 60 when the upper case 50 and the lower case 60 are coupled to each other, the gap between the upper case 50 and the lower case 60 may be sealed. Because the upper case 50 receives downward force due to gravity, the upper case 50 and the lower case 60 may be naturally sealed.

The upper case 50 may also be provided in approximately a box shape. A lower surface of the upper case 50 may be provided to be opened. The upper case 50 may include a front wall 51, a rear wall 52, a left wall 53, a right wall 54, and a ceiling portion 55.

When the upper case 50 and the lower case 60 are coupled with each other, a storage space 70 may be formed inside the upper case 50 and the lower case 60. The storage space 70 may be a space sealed from the outside except for ventilation holes 71 and 72 which will be described later.

The storage container 40 may include the ventilation holes 71 and 72 for communicating the storage space 70 and the outside. In the present embodiment, two ventilation holes 71 and 72 are provided, but the present disclosure is not limited thereto. For example, three or more ventilation holes may be provided, or only one ventilation hole may be provided.

When only one ventilation hole is provided, cold air may flow in and out through the one ventilation hole. That is, the one ventilation hole acts as both the inflow hole and outflow hole. However, two or more ventilation holes 71 and 72 may allow cold air to flow more smoothly.

When the storage container 40 is disposed in the storage compartment, cold air from the storage compartment may mainly flow into the storage container 40 through any one of the plurality of ventilation holes 71 and 72 due to the flow of the cold air of the storage compartment.

In the same manner, the air of the storage container 40 may mainly flow out to the outside of the storage container 40 through another ventilation hole. Thus, any one of the plurality of ventilation holes 71 and 72 may be the inflow hole and the other thereof may be the outflow hole.

However, when the flow of the cold air of the storage compartment has no particular directivity, the cold air may flow in and out through both of the plurality of ventilation holes 71 and 72.

The ventilation holes 71 and 72 may be formed on any one of the upper case 50 and the lower case 60. However, in the present embodiment, both of the plurality of ventilation holes 71 and 72 are formed on the lower case 60. This is intended to facilitate attachment/detachment of deodorizing filters 80 and 90 which will be described later.

The plurality of ventilation holes 71 and 72 may be respectively formed on the left and right walls 63 and 64 of the lower case 60. This is because the handle units 66 and 67 for facilitating pushing and pulling of the storage container 40 in and out are formed in the front wall 61 and the rear wall 62 of the lower case 60.

However, positions of the ventilation holes 71 and 72 are not limited to the left wall 53 and the right wall 64, and as shown in embodiments (FIGS. 10 and 11) which will be described later, the ventilation holes 71 and 72 may be formed in the rear wall and the front wall, or formed in the rear wall and one side wall. This may be appropriately changed in accordance with directivity of the cold air inside the storage compartment.

Upper ends of the plurality of ventilation holes 71 and 72 may be opened in the left wall 63 and the right wall 64 of the lower case 60. Thus, the deodorizing filters 80 and 90 may be easily mounted in the plurality of ventilation holes 71 and 72 while traveling downward from above through the opened upper end, and easily removed from the plurality of ventilation holes 71 and 72 while traveling upward from below.

Each of the upper case 50 and the lower case 60 may be integrally formed by injection molding.

The deodorizing filters 80 and 90 are used for removing odor-causing materials contained in air that flows through the ventilation holes 71 and 72, and detachably mounted in the ventilation holes 71 and 72. In the present embodiment, the plurality of ventilation holes 71 and 72 are provided, and therefore the plurality of deodorizing filters 80 and 90 may also be provided. Configurations of the plurality of deodorizing filters 80 and 90 are the same, and thus the configurations may be collectively referred to and described below.

The deodorizing filters 80 and 90 include deodorizing units 81 and 91 which adsorb the odor-causing materials and frame units 82 and 92 which are provided in edges of the deodorizing units 81 and 91 to support the deodorizing units 81 and 91. The frame units 82 and 92 may have an approximately rectangular frame shape.

The deodorizing filters 80 and 90 may be fitted in the lower case 60.

For this, coupling grooves 83 and 93 in which the lower case 60 is inserted may be provided in the frame units 82 and 92 of the deodorizing filters 80 and 90.

The deodorizing filters 80 and 90 may include hooks 84 and 94 made of an elastic material so that the deodorizing filters 80 and 90 can be fixed to the lower case 60 in a state of being coupled to the lower case 60. When the deodorizing filters 80 and 90 travel downward from above, the hooks 84 and 94 are inserted in latching grooves 68 and 69 formed in the lower case 60 by an elastic force, whereby the deodorizing filters 80 and 90 can be fixed in a state of being coupled to the lower case 60.

When the deodorizing filters 80 and 90 are to be removed from the lower case 60, the hooks 84 and 94 are separated from the latching grooves 68 and 69 by spreading the hooks 84 and 94 by a force larger than the elastic force, and then the deodorizing filters 80 and 90 may be removed from the lower case 60 by lifting the deodorizing filters 80 and 90.

The deodorizing units 81 and 91 include activated carbon with a plurality of pores which adsorb odor-causing materials. A catalyst for inducing chemical adsorption may be impregnated in the activated carbon. This is intended to enable acidic and basic odor-causing materials which are not easily physically adsorbed onto the pores of the activated carbon to be chemically adsorbed onto the pores.

As the catalyst, a catalyst that is specialized in adsorption of acidic and basic odors may be used.

As an example, ethylene urea for chemically adsorbing sulfur-based odor-causing materials and phosphoric acid for chemically adsorbing nitrogen-based odor-causing materials may be used. In this manner, when the catalyst is impregnated in the activated acid, deodorizing performance of the deodorizing filter may be increased.

Figure 7:
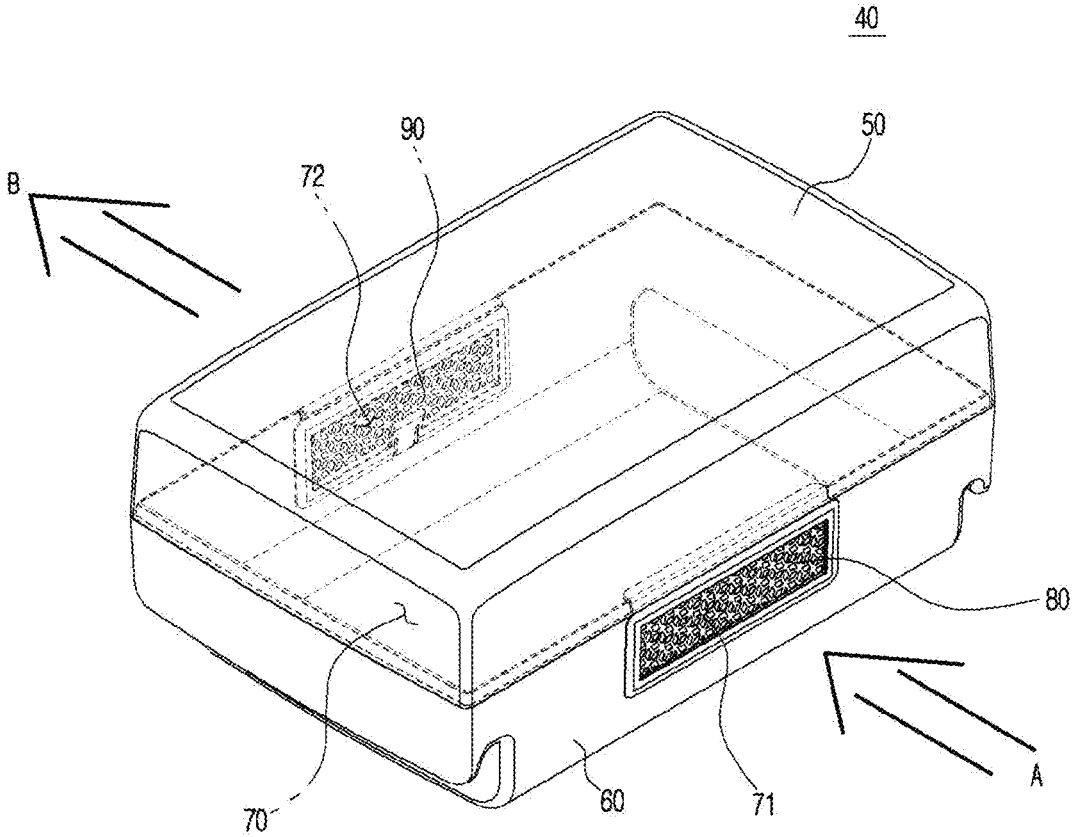
FIG. 7 shows a flow of cold air of the storage container of the refrigerator of FIG. 1.

FIG. 7 shows a flow of cold air of the storage container of the refrigerator of FIG. 1.

With reference to FIG. 7, operations of the storage container 40 in accordance with an embodiment of the present disclosure will be described. By opening the upper case 50 of the storage container 40, foods containing odor-causing materials may be stored in the storage space 70. In this instance, the foods may be directly stored in the storage space 70, may be wrapped using a wrap or the like to be stored, or may be stored in a separate container and then the separated container may be stored in the storage space 70.

When the upper case 50 is closed after storing the food, the storage space 70 may be sealed except for the ventilation holes 71 and 72 provided on both sides of the lower case 60, and cold air may flow only through the ventilation holes 71 and 72 provided on both sides of the lower case 60.

In this instance, when a flow of the cold air of the storage compartment into which the storage container 40 is pushed is the same as directions of arrows A and B, the ventilation hole provided at a side in which the cold air flows into the storage container 40 may be the inflow hole 71, and the ventilation hole provided at a side in which the cold air flows out of the storage container 40 may be the outflow hole 72. The deodorizing filters 80 and 90 may be respectively mounted in the inflow hole 71 and the outflow hole 72.

The cold air of the storage compartment may flow into the storage space 70 of the storage container 40 through the inflow hole 71. In this instance, when the odor-causing material is already in the storage compartment, the odor-causing material may be adsorbed by the deodorizing filter 80 mounted in the inflow hole 71, whereby the adsorbed odor-causing material can be prevented from penetrating inside the storage container 40.

The cold air of the storage space 70 may be discharged to the storage compartment again through the outflow hole 72. In this instance, the odor-causing material of the food stored in the storage space 70 may be adsorbed by the deodorizing filter 90 mounted in the outflow hole 72 to be removed, whereby odors cannot be transferred to the outside of the storage container 40.

Because the cold air of the storage compartment continuously flows to the storage container 40 through the inflow hole 71 and the outflow hole 72, the food stored in the storage container 40 may be kept fresh for a long time.

Even when there is no particular directivity in the cold air inside the storage compartment, the odor-causing material of the food stored in the storage container 40 may be adsorbed by the deodorizing filters 80 and 90. This is because a pressure inside the storage container 40 is increased by the odor-causing material inside the storage container 40 to cause the odor-causing material to naturally move towards the outside of the storage container 40 due to the principle of equilibrium shift. In this instance, the odor-causing material may move toward the inflow hole 71 and the outflow hole 72 because other portions are sealed.

In this instance, the deodorizing filters 80 and 90 are mounted in the inflow hole 71 and the outflow hole 72, and therefore the odor-causing material is adsorbed on the deodorizing filters 80 and 90 without spreading to the outside.

Figure 8:
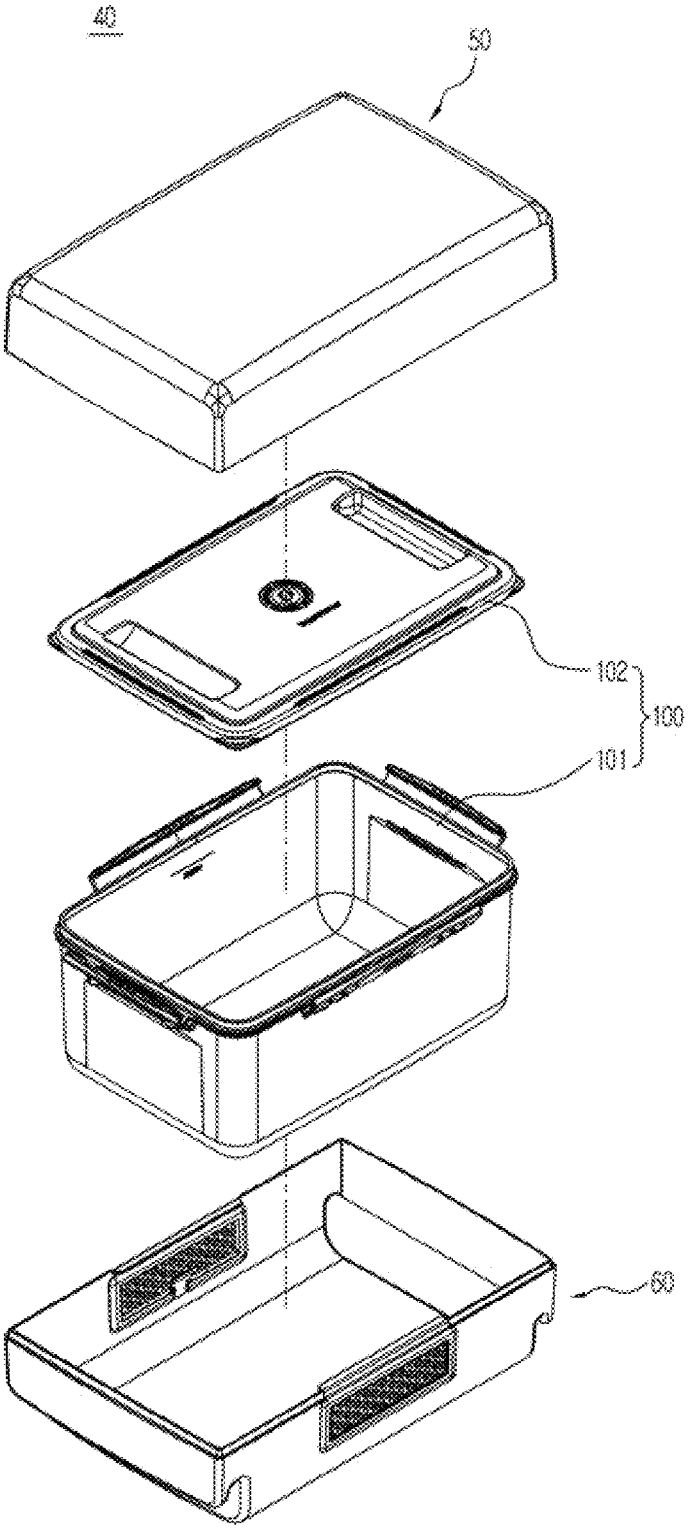
FIG. 8 shows a state in which a separate primary storage container is stored inside the storage container of the refrigerator of FIG. 1.
Figure 9:
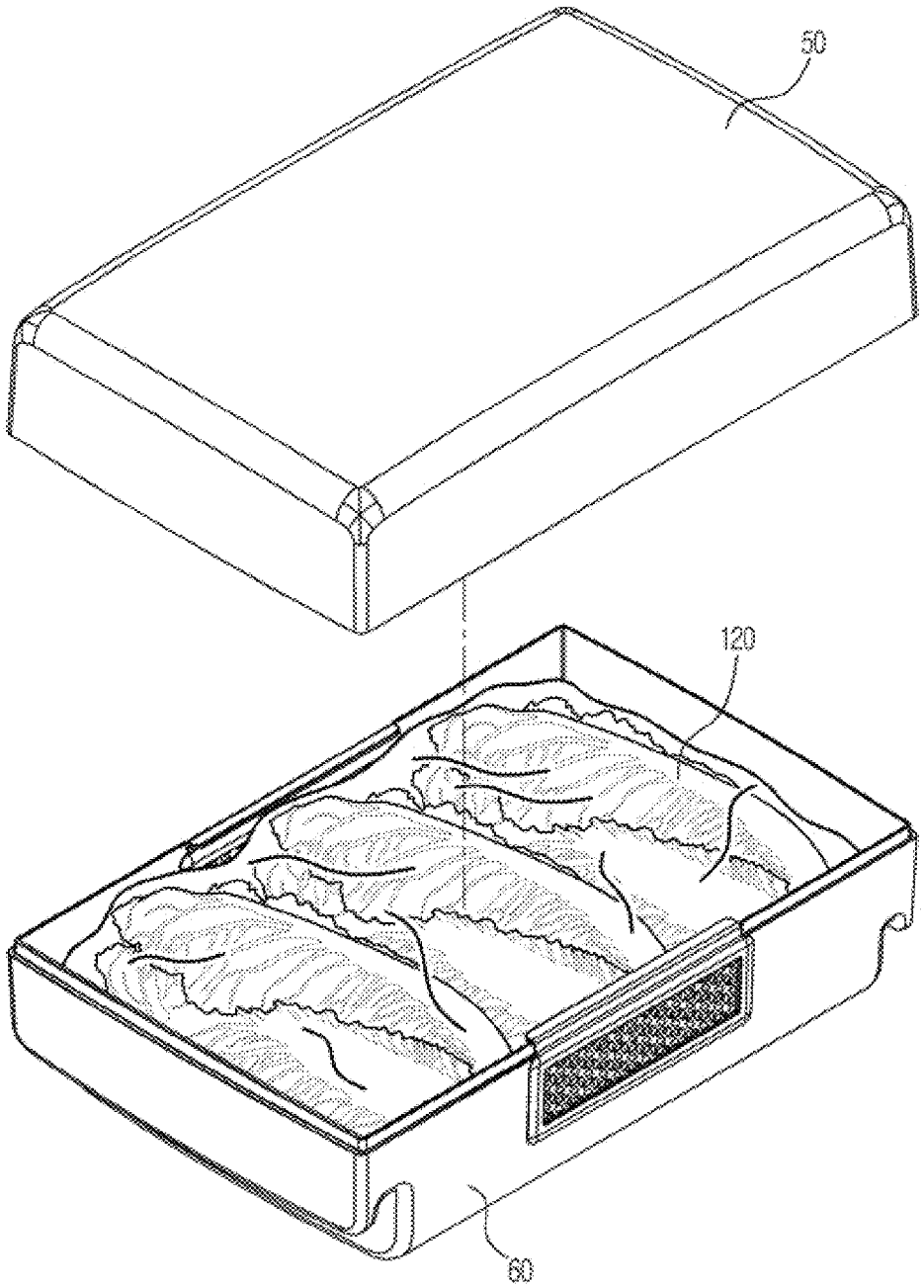
FIG. 9 shows a state in which foods are directly stored inside the storage container of the refrigerator of FIG. 1.

FIG. 8 shows a state in which a separate primary storage container is stored inside the storage container of the refrigerator of FIG. 1, and FIG. 9 shows a state in which foods are directly stored inside the storage container of the refrigerator of FIG. 1.

With reference to FIGS. 8 and 9, an example in which the storage container is used will be described. As shown in FIG. 8, a separate primary storage container 100 may be stored inside the storage container 40 according to the present disclosure.

That is, a food containing an odor-causing material may be primarily stored in the primary storage container 100, and then stored in the deodorization and freshness storage container 40 according to the present disclosure. The primary storage container 100 may be a generally used sealed container. The primary storage container 100 may include a lower case 101 and an upper case 102 that covers an opened upper surface of the lower case 101. Thus, the odor-causing material of the food may be primarily blocked through the primary storage container 100, and the odor-causing material to be emitted to the outside of the primary storage container 100 may be adsorbed on the deodorizing filters 80 and 90 of the storage container 40 according to the present disclosure.

The cold air of the storage compartment may flow into the storage container 40, and therefore the primary storage container 100 may be rapidly cooled to such that food stored inside the primary storage container 100 is kept fresh.

As shown in FIG. 9, the food 120 may be directly stored inside the storage container 40 without the separate primary storage container.

Figure 10:
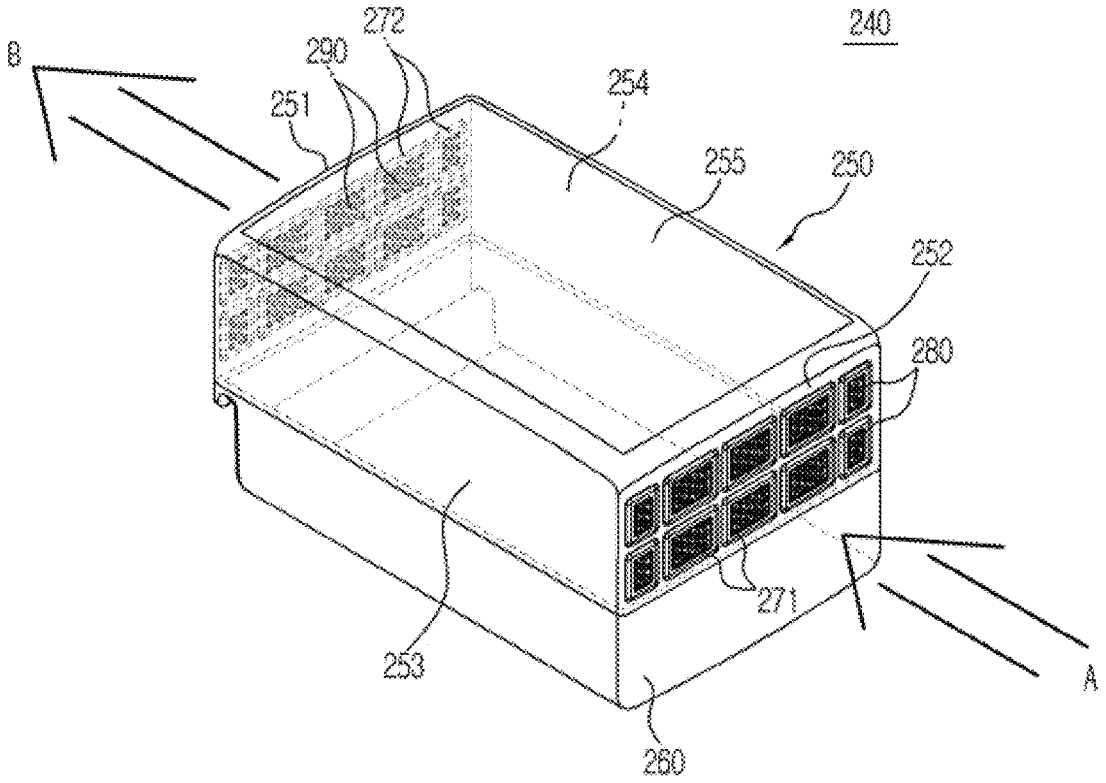
FIGS. 10 and 11 show a storage container in accordance with an embodiment of the present disclosure.
Figure 11:
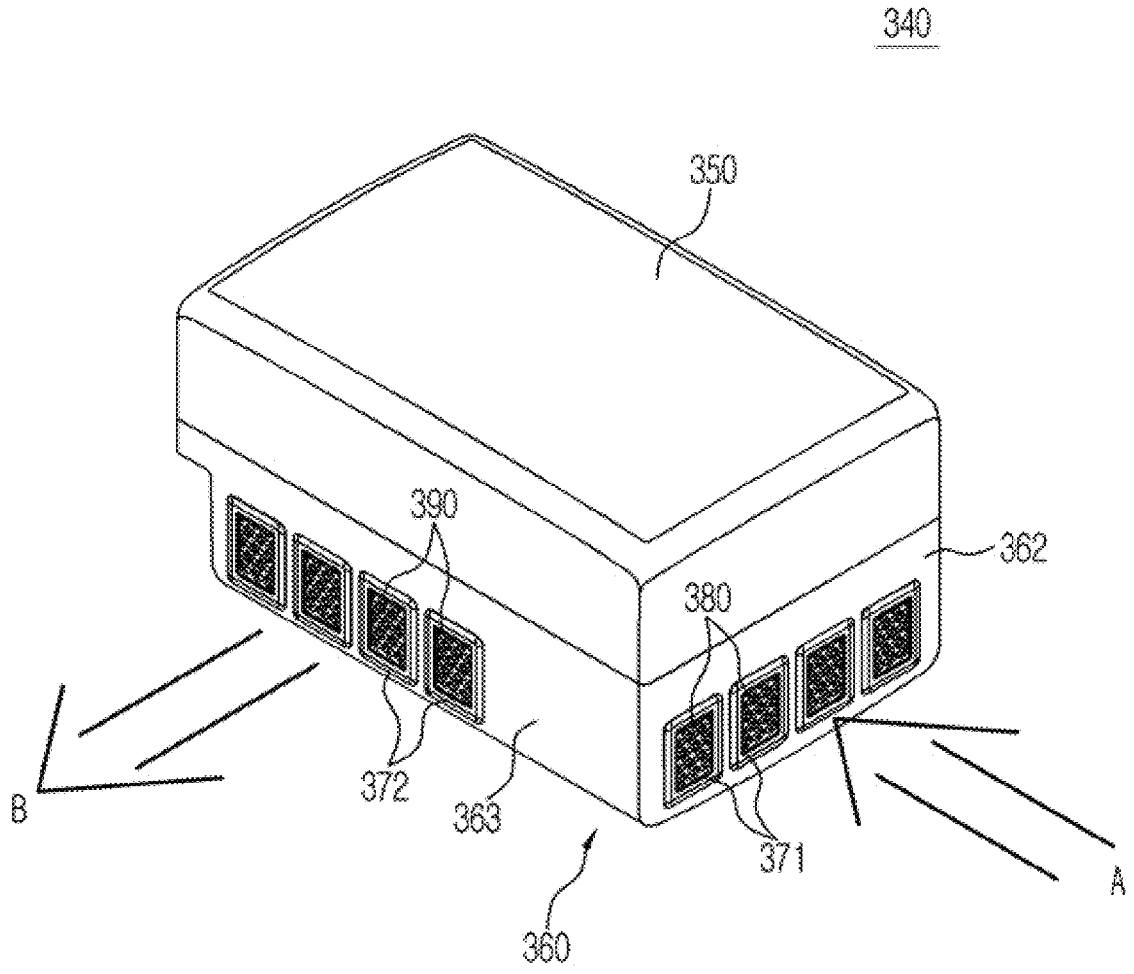

FIGS. 10 and 11 show a storage container in accordance with an embodiment of the present disclosure.

As described above, the position of the ventilation hole is not limited to the upper case and the lower case, or front and rear and left and right positions. That is, the position of the ventilation hole may be appropriately changed in accordance with directivity of the cold air inside the storage compartment and a size and a shape of the storage container.

As an example, as shown in FIG. 10, a plurality of ventilation holes 271 and 272 may be formed respectively in a rear wall 252 and a front wall 251 of the upper case 250. Through such a structure, ventilation of a storage container 240 may be further improved in a case in which the cold air of the storage compartment flows with back to front directivity, as illustrated by arrows A and B.

The ventilation hole 271 of the rear wall 252 acts as an inflow hole, and the ventilation hole 272 of the front wall 251 acts as an outflow hole.

The storage container 240 includes the upper case 250 and the lower case 260, and the upper case 250 includes the front wall 251, the rear wall 252, a left wall 253, a right wall 254, and a ceiling portion 255. The above-described deodorizing filters 280 and 290 may be mounted in the respective ventilation holes 271 and 272.

As shown in FIG. 11, ventilation holes 371 and 372 may be formed respectively in a rear wall 362 and a side wall 363 of a lower case 360 of a storage container 340, having an upper case 350. Such a structure may be effective in a case in which cold air flows in deodorizing filter 380 from a rear side of the storage container 340 and the cold air flows out of deodorizing filter 390 in the side of the storage container 340, as illustrated by arrows A and B.

As is apparent from the above description, in accordance with the embodiments of the present disclosure, the storage container includes the inflow hole and the outflow hole through which cold air flows in and out, and the deodorizing filters for removing odorous materials are mounted in the inflow hole and the outflow hole, and therefore, when foods containing odor-causing materials are put in the storage container to be stored in the storage compartment, the odor-causing materials are prevented from spreading inside the storage compartment, thereby fundamentally removing odors of the storage compartment. In addition, the cold air of the storage compartment continuously flows in and out of the storage container through the inflow hole and the outflow hole, and therefore foods stored in the storage container may be kept fresh.

The deodorizing filter may be detachably mounted in the storage container, and therefore the deodorizing filter may be removed and replaced when it has expired after a predetermined period of use.

The deodorizing filter may be fitted in or removed from the storage container while traveling downward from above, and therefore attachment/detachment of deodorizing filter may be facilitated.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A storage container comprising:

a lower case whose upper surface is opened;

an upper case detachably coupled to an upper portion of the lower case to cover the opened upper surface of the lower case, and coupled to the upper portion of the lower case to form an inner storage space together with the lower case;

at least one inflow hole that is provided in at least one of the lower case and the upper case to enable outside air to flow into the inner storage space;

at least one outflow hole that is provided in at least one of the lower case and the upper case to enable air of the inner storage space to flow out of the inner storage space; and a plurality of deodorizing filters that are respectively mounted in each of the at least one inflow hole and the at least one outflow hole, wherein the at least one inflow hole and the at least one outflow hole are respectively formed at a rear side of the at least one of the lower case and the upper case and a front side thereof, or respectively formed at both sides of the at least one of the lower case and the upper case so that the at least one inflow hole and the at least one outflow hole face each other.

2. The storage container according to claim 1, wherein a gap between the lower case and the upper case is sealed so that the outside air flows into and out of the storage space only through the at least one inflow hole and the at least one outflow hole.

3. The storage container according to claim 1, wherein the deodorizing filters are detachably mounted in each of the at least one inflow hole and the at least one outflow hole.

4. The storage container according to claim 1, wherein the at least one inflow hole and the at least one outflow hole are formed on both side walls of the lower case in such a manner that an upper end of each of the at least one inflow hole and the at least one outflow hole is opened, so that the deodorizing filters are mounted to travel downward from above through the opened upper end.

5. The storage container according to claim 4, wherein the deodorizing filters are fitted into both of the side walls of the lower case.

6. The storage container according to claim 5, wherein the deodorizing filters include coupling grooves into which the lower case is fitted.

7. The storage container according to claim 4, wherein an elastic hook is provided in each of the deodorizing filters, a latching hole in which the elastic hook is inserted is provided on both of the side walls of the lower case, and the elastic hook is inserted into and fixed to the latching hole, so that the deodorizing filters are fixed when mounted.

8. The storage container according to claim 1, wherein a handle unit is respectively formed in a front wall of the lower case and a rear wall thereof.

9. The storage container according to claim 1, wherein the deodorizing filters include activated carbon having a plurality of pores that adsorbs odorous materials, and a catalyst that is impregnated in the activated carbon to help chemical adsorption of the odorous materials.

10. The container according to claim 9, wherein the catalyst includes a catalyst that is specialized in adsorption of acidic and basic odors.

11. A storage container for use in a refrigerator having a main body, a storage compartment, and a door, the storage container comprising:

a lower case whose upper surface is opened;

an upper case detachably coupled to an upper portion of the lower case to cover the opened upper surface of the lower case, and coupled to the upper portion of the lower case to form an inner storage space together with the lower case;

at least one ventilation hole that is provided in at least one of the lower case and the upper case to enable outside air to flow into and out of the inner storage space; and at least one deodorizing filter that is mounted in the at least one ventilation hole to prevent odors of foods received in the inner storage space of the storage container from spreading outside the inner storage space.

12. A refrigerator comprising:

a main body;

a storage compartment that is formed inside the main body;

a door that opens and closes the storage compartment; and a storage container that is received in the storage compartment, wherein the storage container comprises a lower case and an upper case which form an inner storage space and are detachably coupled to each other;

at least one ventilation hole that is formed in at least one of the lower case and the upper case to enable cold air of the storage compartment to flow into and out of the inner storage space; and at least one deodorizing filter that is mounted in the at least one ventilation hole to prevent odors of foods received in the inner storage space of the storage container from spreading to the storage compartment.

13. The refrigerator according to claim 12, wherein the at least one deodorizing filter is detachably mounted in the at least one ventilation hole.

14. The refrigerator according to claim 12, wherein the at least one ventilation hole includes at least one inflow hole through which cold air of the storage compartment flows into the inner storage space of the storage container, and at least one outflow hole through which air of the inner storage space of the storage container flows out into the storage compartment.

15. The refrigerator according to claim 12, wherein the lower case comprises a front wall, a rear wall, both side walls, and a bottom portion, the at least one ventilation hole is formed on each of the side walls, and a handle is formed on each of the front wall and the rear wall.

* * * * *